US005579899A

United States Patent [19]

Arnold

[11] Patent Number: 5,579,899

[45] Date of Patent: Dec. 3, 1996

[54] SWITCH ACTUATING UNIT

[75] Inventor: Wolfgang Arnold, Hardt, Germany

[73] Assignee: Mannesmann Aktiengesellschaft, Düsseldorf, Germany

[21] Appl. No.: 426,929

[22] Filed: Apr. 21, 1995

[30] Foreign Application Priority Data

Apr. 21, 1994 [DE] Germany ..... 44 16 066.6

[51] Int. Cl.[6] ..... H01H 3/42

[52] U.S. Cl. ..... 200/47; 200/573; 200/542

[58] Field of Search ..... 200/573, 542, 200/47

[56] References Cited

U.S. PATENT DOCUMENTS 3,192,349 6/1965 Horberg, Jr. ..... 200/573
3,676,625 7/1972 Blatt ..... 200/542
3,937,912 2/1976 Martin ..... 200/573 X
5,005,923 4/1991 Dahnert ..... 200/573 X

*Primary Examiner*—Renee S. Luebke
*Attorney, Agent, or Firm*—Cohen, Pontani, Lieberman, Pavane

[57] ABSTRACT

The present invention is a switch actuating unit having at least one electrical or electromechanical limiting position switch, actuatable by a mechanical sensing device. This unit structurally combines the mechanical sensing device and the electrical switches such that the switches are activated in at least two limiting positions by a common actuating plunger. The plunger extends from either side of the unit and actuates the switches upon engagement with a stop or flange plate defining each of the limit positions. Furthermore, the sensing device and switches are structurally combined so as to be moveable together.

11 Claims, 2 Drawing Sheets

SWITCH ACTUATING UNIT

BACKGROUND OF THE INVENTION

1. Field of the Invention

The present invention relates to switch actuating units and, more particularly, to switch actuating units having electrical or electromechanical limit position switches actuatable by a mechanical sensing device.

2. Description of the Related Art

Switch actuating units are well known in the art. For example German Patent No. DE-AS 2511603 describes a switch actuating unit for a driven shaft, especially a threaded spindle. This unit has limit switches located at opposite ends of the threaded spindle. The threaded spindle has a threaded actuating element mounted thereon which runs along the spindle as the spindle rotates. The direction of movement is towards one or the other of the limit switches and is dependent on the direction of the rotation of the spindle. When the actuating element reaches one of the limit switches at an end position, the switch is actuated and the drive for the threaded spindle is shut off.

A disadvantage of this device is due to the mounting position of the limit switches. Because the switches are at either end of the spindle, the actuating element moves independently of the switches and it is necessary to wire the switches accordingly. If the end position of the actuating elements are to be retrofitted, wiring the switches on moving parts of the system, as would be necessary here, poses mounting problems and creates a risk that the wires could be damaged by the moving parts. For the embodiment described by this German patent secure mounting of the switches is only possible at the end positions of the spindle and thus, the disadvantages mentioned above are inherent to this device.

It is thus desirable to produce a switch actuating unit which can be easily retrofitted. Production of such a unit in which the switches move together with the actuating element is also desirable. This device should also eliminate the possibility of damaging any wiring during mounting, retrofitting and operation.

SUMMARY OF THE INVENTION

It is thus an object of the present invention to produce a switch actuating unit which can be easily retrofitted and is mounted in a manner which provides both mechanical and electrical protection from damage during mounting, retrofitting and operation of the device.

This object is achieved in the present invention by structurally combining a sensing device with the switches. The sensing device and switches of the present invention are designed to be movable together. Furthermore, the switches are activated in at least two end or limit positions by a common actuating plunger.

The switch actuating unit of the present invention includes a drive housing and a switch housing. The drive housing causes the unit to move towards its limit positions. In certain embodiments the limit positions may be caused to move towards a stationary switch actuating unit. The switch housing includes at least one electrical switch and a plunger element engagable therewith. The plunger element extends from the switch housing and, when the unit approaches a limit position, the plunger element encounters a stop or flange plate at the limit position. When the plunger encounters the stop or flange plate, it is caused to engage with and activate the electric switch.

In contrast to the prior art, the sensing device of the present invention is structurally combined with the switches. During operation, when used with a pressure-medium cylinder for example, the sensing device and switches are moved commonly between the limit positions. Thus, it is unnecessary to locate the switches at the ends or limiting positions of the unit and the need for the corresponding wiring of the switches is eliminated. The switches and the sensing device may be moved together along the carriage of the unit. An example of such a unit is a pressure-medium-operated working cylinder. A plurality of adjustable cams may be located on the actuating plunger. These adjustable cams can effect the actuation of a respective one of the limit switches responsible for each end position when reached by the plunger and also ensure that a chronological sequence of switch activation and deactivation results when an end or limit position is reached. The extent to which the actuating plunger ends project from the housing forms the length of the actuating path of the unit. This actuating path is also related to the intervals between the adjustable cams mounted on the actuating plunger. The position of the cams controls the time at which the electric switches are actuated. Thus, a pre-end position can be determined before an absolute end position is reached. At the pre-end position, the plunger is briefly controlled for damped braking until the absolute end position is reached. This provides a significant advantage for units such as pressure-medium operated cylinders.

The same applies to electrically and electromechanically operated axes or short stroke axes.

Furthermore, a single common actuating plunger for both end positions may be used. The actuating plunger may include two actuating plunger elements which slide into one another in a telescopically arranged manner. The plunger elements are forced apart from one another by a compression spring. The two actuating plunger elements are positioned within the housing by snap rings that abut the respective inside walls of the housing providing a resistance force to the force of the compression spring. The respective actuating plunger elements then project through a respective opening in the housing and extend a corresponding distance therefrom.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, where like reference numerals denote similar elements throughout the several views.

DETAILED DESCRIPTION OF THE PREFERRED EMBODIMENTS

Figure 1:
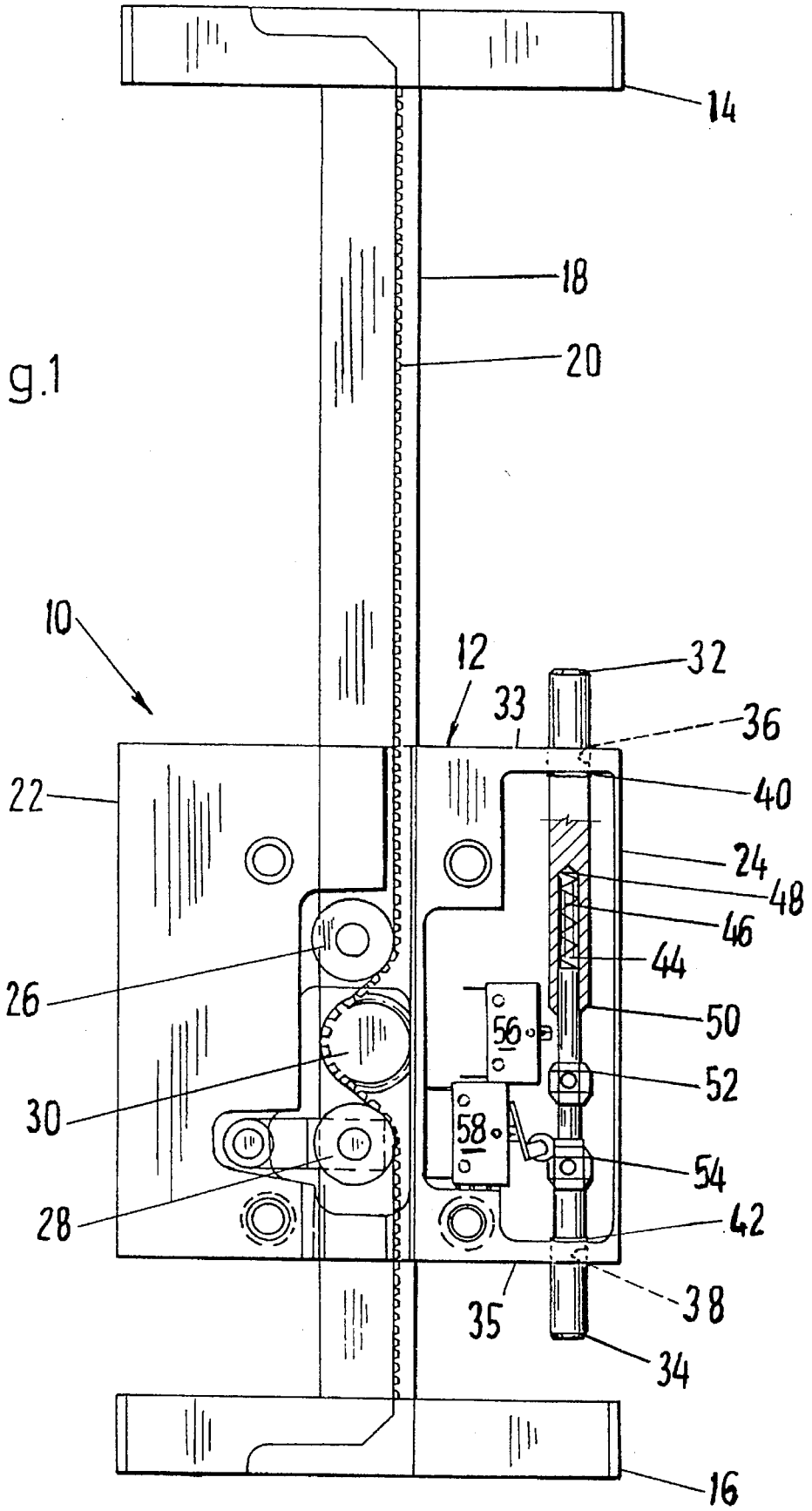
FIG. 1 is a top cross-sectional view of a switch actuating unit according to the present invention attached to a short stroke axis.

Referring now to the drawings in detail and initially to FIG. 1 thereof, the present invention constitutes an electrically operated short stroke axis 10 having a switch actuating unit 12 mounted thereon. The short stroke axis includes two flange plates 14, 16 connected together by a connecting rod 18. Attached between the flange plates 14, 16 and along the connecting rod 18 is a toothed belt 20. The toothed belt 20 is stretched along the length of the connecting rod 18 and connected on either end to a respective one of the flange plates 14, 16. The switch actuating unit 12 is positioned on the connecting rod 18 for movement therealong. The switch actuating unit includes a drive housing 22 and a switch housing 24.

The drive housing 22 includes two rollers 26, 28 and a toothed drive wheel 30. The toothed belt 20 is fed over a first of the two rollers 26, guided around the toothed drive wheel 30 and then fed back over the second of the two rollers 28. The teeth of drive wheel 30 are formed to mesh with the teeth of the toothed belt 20 when in its proper position. When the drive wheel 30 is actuated, it rotates, its teeth interengaging with the toothed belt 20, causing the switch actuating unit 12 to move along the connecting rod 18 in a direction dependent upon the rotational direction of the drive wheel 30. Actuation of the drive wheel 30 may be either electrical or mechanical.

The switch housing 24 is mounted on and moves with the drive housing 22. The switch housing 24 includes an actuating plunger having two actuating plunger elements 32, 34. The actuating plunger elements 32, 34 are positioned so as to project from respective sides 33, 35 of the switch housing 24 through respective openings 36, 38 in the respective sides 33, 35 of the switch housing 24. Each of the actuating plunger elements 32, 34 also has a limiting or stop device placed thereabout which holds plunger elements 32, 34 within the switch housing 24. This limiting or stop device may be in the form of a snap ring 40, 42 or any other suitable stop element which will abut a respective side wall 33, 35 for holding or retaining the plunger elements 32, 34 within the housing 24. The snap rings 40, 42 are positioned around a respective actuating plunger element 32, 34 and within the switch housing 24 in proximity to a respective opening 36, 38 in the switch housing 24.

A first of the actuating plunger elements 32 has a larger diameter than the second actuating plunger element 34. The first actuating plunger element 32 also includes a recess 44 in one end thereof. The second actuating plunger element 34 is positioned so that one end extends into the recess 44. The two actuating plunger elements 32, 34 are thus connected in a telescoping manner. Also within the recess 44 is a compression spring 46. The compression spring 46 is positioned between a base 48 of the recess 44 and the second actuating plunger element 34 and holds the actuating plunger elements 32, 34 at a working distance from one another through the spring force. The compression spring 46 exerts a force on the first plunger element 32 towards the opening 36 and on the second plunger element 34 towards the opening 38 in the switch housing 24. In order to hold the actuating plunger elements 32, 34 within the switch housing 24 the snap rings 40, 42 limit the outward movement of the respective actuating plunger elements 32, 34 and are of a diameter larger than the openings 36, 38. The snap rings 40, 42 are positioned proximate to and exert a force on respective inner walls 33, 35 of the switch housing 24 with which they are in contact. The force on the inner wall is a resistance force exerted in response to the force of the compression spring 46 on the plunger elements 32, 34. The snap rings 40, 42 also act to hold the respective actuating plunger elements 32, 34 in place within the switch housing 24.

It is also possible to slide the second actuating plunger element 32 within the recess 44 of the first actuating plunger element 34 to the extent that both the first and second plunger elements 32, 34 are completely within the switch housing 24. In this manner, both the telescope design and the position of the compression spring 46 make a provision for a minimum extension of the actuating plunger elements 32, 34 from the switch housing 24. This position is useful for a stroke axis having an extremely short stroke, i.e., a short connecting rod 18, in which the actuating plunger elements 32, 34 somehow abut either one or both flange plates 14, 16 in every position of the switch actuating unit 12.

Displaceable and lockable switch cams 52, 54 are also positioned on the second plunger element 34. These switch cams 52, 54 are slidable along and lockable to the second plunger element 34 as by set screws or the like. The switch cams 52, 54 are also positioned to actuate two electrical switches 56, 58. The switches 56, 58 are located within the switch housing 24 and positioned in a parallel relationship with the actuating direction of the plunger elements 32, 34 with respect to the switch actuating points. Each of the switches 56 and 58 are able to be actuated by the respective switch cams 52 and 54 when a limit position is reached by the second plunger element 34 of the unit 12.

The first actuating plunger element 32 is also provided with a chamfered edge 50 around the entrance to the recess 44. This chamfered edge 50 is able to actuate the switch 56 when a limit position is reached by the first plunger element 32 of the unit 12.

Figure 2:
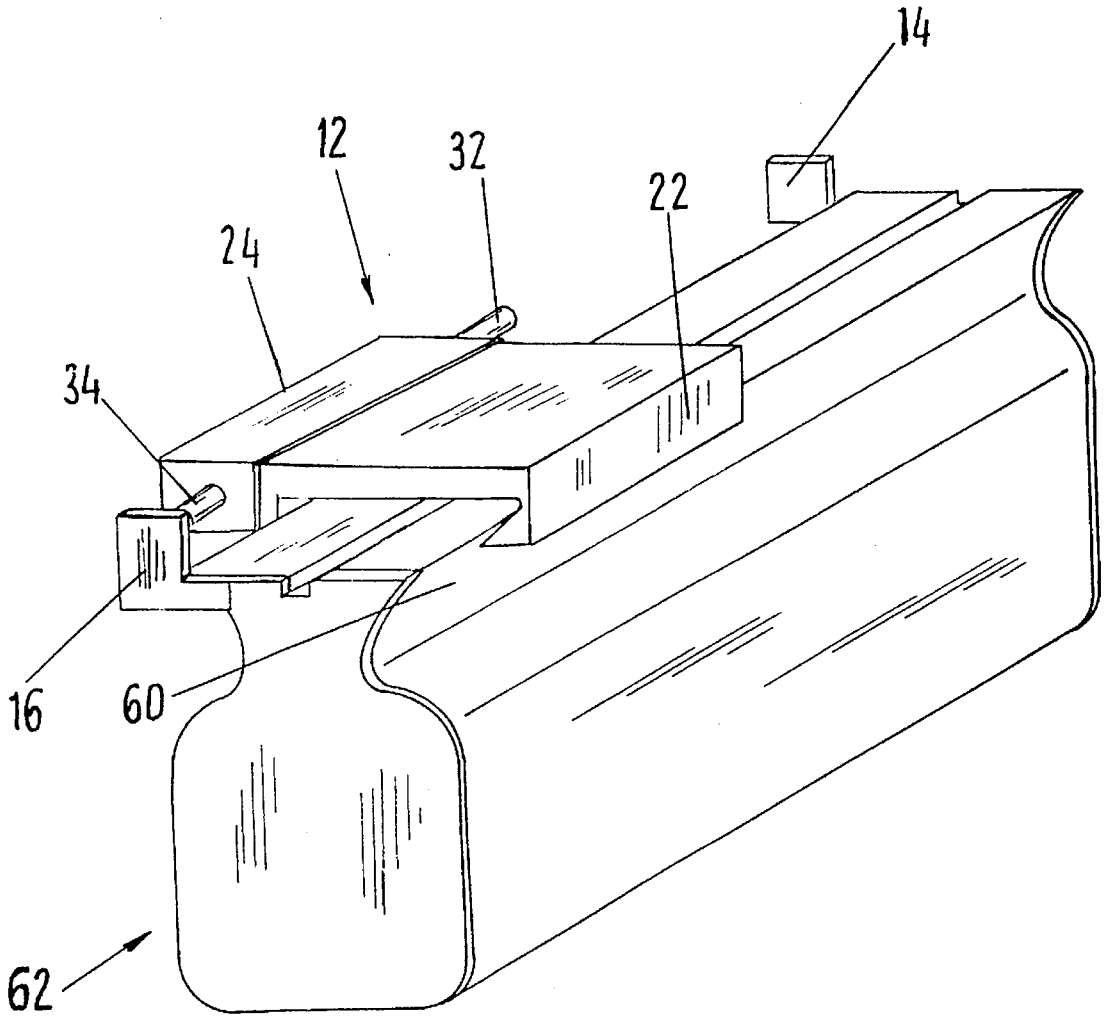
FIG. 2 is a perspective view of the switch actuating unit according to the present invention attached to a working cylinder.

FIG. 2 illustrates an actuating switch unit 12 used on a pressure medium working cylinder, i.e. a piston-rod-less tension strip cylinder. The drive housing 22 is positioned so as to be externally guided on a carriage 60 of the cylinder 62. The switch housing 24 is similarly located on the carriage 60 and adjacent to the drive housing 22. Corresponding flange plates 14, 16 are located at the end or limit positions of the carriage 60 for engagement with the respective plunger elements 32, 34. As the unit 12 moves along the carriage 60 towards one of the end or limit positions, a respective one of the plungers 32 or 34 engages a flange 14 or 16 at that end or limit position and acts to actuate a switch within the switch housing 24.

The operation of the present invention will now be described in more detail. The unit can be operated using two methods.

One method of operation is when both the drive and switch housings 22, 24 are permanently mounted in a stationary position on the connecting rod 18 and the flange plates 14, 16 may move, in common, towards the ends of the switch housing 24. In this case, the system elements to be activated would be mounted within the switch housing and also would remain stationary.

The second method of operation is when the flange plates 14, 16 are mounted to the connecting bar 18 and the drive and switch housings 22, 24 are movably mounted so they may move along the connecting rod 18 towards the flange plates 14, 16. In this case, the system elements to be activated would be mounted to the drive element 22 and likewise be moveable along the connecting bar 18. In either method the relative movements of the flanges 14, 16 and the unit 12 are the same with respect to the connecting bar 18.

The operation of the unit will now be described with respect to the first method. The operation with respect to actuating the switches is identical in both methods wherein the first method will be described below for purposes of explanation only. In the instance in which the flange plates 14, 16 travel in common, let it first be assumed that the drive is operated to move flange plates 14, 16 in a downward direction as viewed in FIG. 1, wherein flange plate 14 travels towards the unit 12 and flange plate 16 travels away from the unit 12. The drive will continue to move the flange plate 14 towards the unit 12 until flange plate 14 contacts and presses against the first actuating plunger element 32. The position at which the flange plate 14 contacts the first plunger element 32 is called the end or limit position. Further downward movement of flange plate 14 forces the plunger element 32 into the switch housing against the compression bias of spring 46 while the other plunger element 34 remains stationary by virtue of the snap ring 42 engaging the housing wall 35 to prevent such movement. The downward movement of the first plunger element 32 then causes its chamfered edge 50 to engage the actuation member of limit switch 56 to activate the switch 56. The activation of this switch 56 may, for example, make a circuit or break a circuit. If used to break a circuit, this may produce an emergency cutoff for such circuit. Thus, the chamfered edge 50 of the first actuating plunger 32 acts as a switch cam to activate switch 56 when the flange plate 14 presses on the first actuating plunger 32, namely the first switch 56 in the embodiment shown in FIG. 1.

When the flange plates 14, 16 are moved by the drive in the opposite (upward) direction, the other flange plate 16 eventually contacts the second plunger element 34 at a second end or limit position. This causes the second plunger element 34 to be forced into the switch housing 24 against the compression bias of spring 46 while the plunger element 32 remains stationary by virtue of its snap ring 40 engaging the housing wall 33 to prevent such movement. The switch cams 52, 54 on the second plunger element 34 move with the second plunger element 34 to contact the operating members of the switches 56, 58. The contact of the switch cams 52 and 54 with the respective switches 56 and 58 causes the switches to be activated. The activating of the switches 56 and 58 may, for example, cause a reference signal to be transmitted to an outside element or device. For example, the contact of switch 56 by switch cam 52 may cause the open circuit formed by contact of the chamfered edge 50 on switch 56, as discussed previously, to close and thus allow switch 58 to transmit the reference signal. Whether switches 56 and 58 operate simultaneously or in some form of timed sequence is dependent on the location of switch cams 52 and 54 on plunger element 34, as will be readily apparent to one of ordinary skill in the art.

When either of the actuating plunger elements 32, 34 are pressed on by their respective flange plates 14, 16, the compression spring 46 acts to aid the other plunger elements 34, 32 in retaining its position with respect to the switch housing 24. The amount which the plunger elements 32 and 34 extend from the housing effects the timing of the activation of the switches 56, 58. Clearly, there are obvious limitations on the amount of such extension including, among others, the length of recess 44 and the throw of the compression spring 46. The amount of extension of plunger element 32 from the housing effects the timing of the activation of switch 56 by the chamfered edge of the first plunger element 32. The further the first plunger element 32 extends from the switch housing 24, the further the chamfered edge 50 must travel to contact the switch 56 and thus the longer the time will be between contact of the first plunger element with the flange plate 14 and activation of the switch 56. Thus the damping period defined by the pre-end position may be controlled by adjusting the extension of the plunger elements within the physical limits heretofore noted. The activation of the switches 56, 58 by the switch cams 52, 54 depends upon the extension of the second plunger element 34 from the switch housing 24 and positioning of the switch cams 52, 54. The further the plunger elements 32, 34 extend from the switch housing 24 the more room the second plunger element 34 has to slide within the recess 44 when engaging the flange plate 16, again within limits dictated in part by the length of the recess and the throw of compression spring 46. These factors determine the amount of time between contact of the second plunger element 34 with the flange plate 16 and activation of the switches 56, 58. The further the switch cams 52, 54 must travel to contact the respective switches 56, 58 upon contact between the second plunger element 34 and the flange plate 16 the longer the damping period or period before activation will be. Thus, an adequate control of the plunger elements and damped breaking until an absolute end position is reached can be obtained by adjusting the extension of the plunger elements 32, 34 and the position of the switch cams 52, 54.

Thus, while there has been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A switch actuating unit, comprising:

a switch housing disposed between at least two limiting positions, each of said at least two positions being defined by a flange plate, said switch housing being movable relative to said flange plates;

at least one electrical switch mounted within the switch housing; and a mechanical sensing device positioned substantially within said switch housing and including a longitudinally movable plunger extending from the switch housing and engagable with said flange plates for movement thereby, and actuator means mounted on the plunger for actuating said at least one electrical switch to operate in one of an active mode and an inactive mode when said plunger is moved by engagement with one of said flange plates at a respective one of the at least two limiting positions, the actuating plunger including first and second plunger elements, said first and second plunger elements being displaceable relative to one another, said switch housing including first and second openings on opposite ends thereof, said first and second plunger elements each being positioned to extend from said switch housing through a respective one of said first and second openings.

2. The switch actuating unit as claimed in claim 1, wherein said first plunger element includes a recess in one end thereof and a first end of said second plunger element is slidably positioned within said recess in a telescopic fashion.

3. The switch actuating unit as claimed in claim 1, wherein said mechanical sensing device further includes a compression spring positioned within said recess and between said first and second plunger elements yieldably pressing said plunger elements away from one another; and first and second retaining means each positioned about a respective one of said first and second plunger elements and in proximity to a respective one of said first and second openings for limiting the relative movement of said plunger elements away from one another by retaining said respective first and second plunger elements in their respective positions extending from said switch housing.

4. The switch activating unit as claimed in claim 3, wherein said first and second retaining means are snap rings engaging said first and second plunger elements.

5. The switch actuating unit as claimed in claim 3, wherein said actuator includes at least one displaceable and lockable switch cam positioned on said second plunger element for switching said at least one electrical switch between an active mode and an inactive mode when said second plunger element engages a first of said flange plates.

6. The switch actuating unit as claimed in claim 5, wherein said actuator means further includes a chamfered edge of said first plunger element surrounding the entrance to said recess for switching said at least one electrical switch between an active mode and an inactive mode when said first plunger element engages a second of said flange plates.

7. The switch actuating unit as claimed in claim 1, wherein said at least one electrical switch comprises first and second limit position switches positioned within the switch housing in a parallel and side by side manner relative to an actuating direction of said plunger.

8. The switch actuating unit as claimed in claim 7, wherein said actuator includes a switch cam positioned on said second plunger element for switching said first and second limit position switches between an active mode and an inactive mode when a first of said at least two limiting positions is engaged by said second plunger element, and said first plunger element includes a chamfered edge about an entrance to said recess for switching said first and second switches between an active mode and an inactive mode when a second of said at least two limiting positions is engaged by said first plunger element.

9. The switch actuating unit as claimed in claim 1, further comprising means for determining a direction from which the limiting position was engaged based upon a sequence of activation and deactivation of said at least one limit position switch.

10. A switch actuating unit, comprising:

a switch housing disposed between at least two limiting positions, each of said at least two positions being defined by a flange plate, said switch housing being movable relative to said flange plates;

at least one electrical switch mounted within the switch housing;

a mechanical sensing device positioned substantially within said switch housing and including a longitudinally movable plunger extending from the switch housing and engagable with said flange plates for movement thereby, and actuator means mounted on the plunger for actuating said at least one electrical switch to operate in one of an active mode and an inactive mode when said plunger is moved by engagement with one of said flange plates at a respective one of the at least two limiting positions; and an electrical stroke axis connected between said at least two limiting positions, said electrical stroke axis including a connecting rod positioned between said flange plates defining said at least two limiting positions, and a belt extending along said connecting rod and between said flange plates, said switch housing being coupled to said connecting rod and moveable said belt between said flange plates.

11. A switch actuating unit, comprising:

a switch housing disposed between at least two limiting positions, each of said at least two positions being defined by a flange plate, said switch housing being movable relative to said flange plates;

at least one electrical switch mounted within the switch housing;

a mechanical sensing device positioned substantially within said switch housing and including a longitudinally movable plunger extending from the switch housing and engagable with said flange plates for movement thereby, and actuator means mounted on the plunger for actuating said at least one electrical switch to operate in one of an active mode and an inactive mode when said plunger is moved by engagement with one of said flange plates at a respective one of the at least two limiting positions; and a pressure-medium-operated working cylinder connected between said at least two limiting positions, said pressure-medium-operated working cylinder including a carriage connected between said flange plates defining said at least two limiting positions, and a belt extending therealong between said flange plates, said switch housing being coupled to said carriage and moveable along said belt between said first and second flange plates.

* * * * *